US006915645B2

(12) United States Patent
Finkenauer et al.

(10) Patent No.: US 6,915,645 B2
(45) Date of Patent: Jul. 12, 2005

(54) GOODS DISPLAY CABINET

(75) Inventors: Harry Finkenauer, Mainz-Kostheim (DE); Eugen Stall, Neunkirchen-Seescheid (DE)

(73) Assignee: Linde Kaltetechnik GmbH & Co. KG, Cologne (DE)

( * ) Notice: Subject to any disclaimer, the term of this patent is extended or adjusted under 35 U.S.C. 154(b) by 14 days.

(21) Appl. No.: 10/415,556

(22) PCT Filed: Oct. 27, 2001

(86) PCT No.: PCT/EP01/12468

§ 371 (c)(1),
(2), (4) Date: May 1, 2003

(87) PCT Pub. No.: WO02/35968

PCT Pub. Date: May 10, 2002

(65) Prior Publication Data

US 2004/0007948 A1 Jan. 15, 2004

(30) Foreign Application Priority Data

Nov. 4, 2000 (DE) ..... 100 54 788
Oct. 18, 2001 (EP) ..... 01124849

(51) Int. Cl.[7] ..... A47F 3/04
(52) U.S. Cl. ..... 62/89; 62/246; 454/193
(58) Field of Search ..... 62/246–256; 454/193

(56) References Cited

U.S. PATENT DOCUMENTS 4,058,253 A * 11/1977 Munk et al. ..... 236/46 R
4,938,034 A * 7/1990 Rosanio et al. ..... 62/256
5,394,934 A * 3/1995 Rein et al. ..... 165/200
5,931,376 A * 8/1999 Meyer ..... 236/44 C
6,206,775 B1 * 3/2001 Lemaitre et al. ..... 454/75
6,406,367 B1 * 6/2002 Chou et al. ..... 454/233

* cited by examiner

*Primary Examiner*—William E. Tapolcai
(74) *Attorney, Agent, or Firm*—Millen, White, Zelano, Branigan, P.C.

(57) ABSTRACT

An at least partially cooled product display cabinet in which cooling of the area or areas of the product display cabinet to be cooled takes place at least partially by means of a cooling air flow and/or by means of static cooling is described. According to the invention, at least one sensor (a, a', a", b, b', b", c, c', c", d, d', d") that is used to detect contaminants and/or particles of dirt in the cooling air flow is arranged in and/or on the product display cabinet. If the product display cabinet has at least one cooling air inlet area (5, 5', 5") and/or at least one cooling air outlet area (7, 7', 7") and/or at least one evaporator (8, 8', 8"), the sensor or sensors (a, a', a", b, b', b", c, c', c", d, d', d") in the or a cooling air inlet area (5, 5', 5") and/or in the or a cooling air outlet area (7, 7', 7") and/or in the flow direction are located essentially directly upstream or downstream from the evaporator or evaporators (8, 8', 8").

24 Claims, 2 Drawing Sheets

GOODS DISPLAY CABINET

Figure 1:
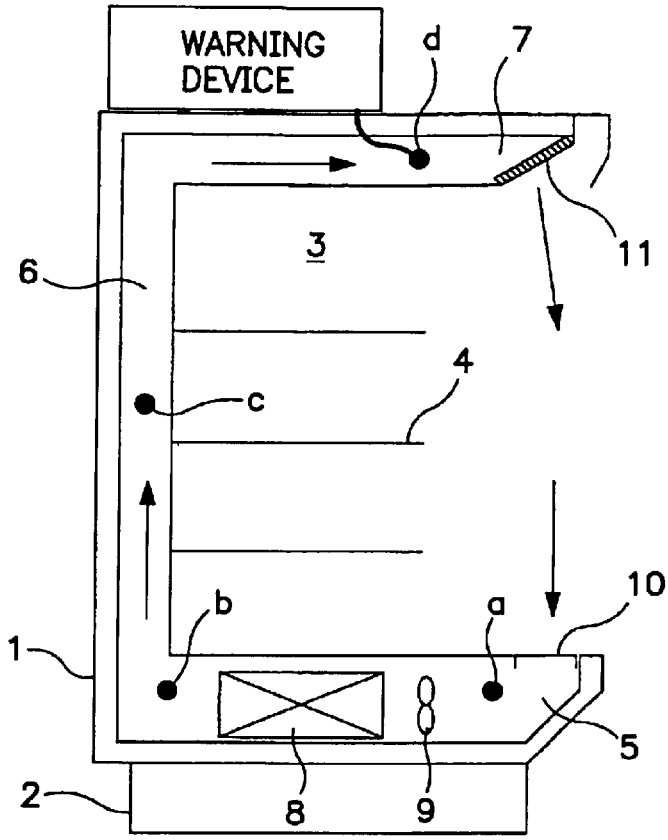

The invention relates to an at least partially cooled product display cabinet in which cooling of the area or areas of the product display cabinet to be cooled takes place at least partially by means of a cooling air flow and/or by means of static cooling.

The expression "product display cabinet" is defined as cabinets of any type that are used for display and/or storage of products, especially freezers or refrigerators, chest freezers, freezer or refrigerator islands, cold shelves, etc.

For cooling these product display cabinets, the required cooling air is taken in from the vicinity of the product display cabinet, cooled by means of devices intended for this purpose within the product display cabinet, and routed into the product space or spaces of the product display cabinet to be cooled.

Alternatively or in addition, there can be so-called "static cooling." In the case of so-called "static cooling," the cooling takes place without the recirculation of air by a fan. Instead, the cooling is implemented by means of refrigerating coils located in the body of the cabinet and/or heat exchangers or evaporators through which a refrigerant or salt water is routed.

To date, the portion of contaminant in the air flow that enters or emerges from the product display cabinet has been ignored. It cannot be avoided, however, that occasionally products—for example due to the prior improper storage—also spoil during proper storage in the product display cabinet. The contaminants formed in this case can be released via the cooling air flow to the room air and under certain circumstances can be delivered to another product display cabinet and thus the products stored therein.

In product display cabinets in the past there was no warning when contaminants formed, for example mold, spores or other harmful cultures, in the cooling air circuit of the product display cabinet.

The object of this invention is to devise a generic product display cabinet in which the penetration of contaminants from the room air surrounding the product display cabinet into the product display cabinet and the release of contaminants from the product display cabinet to the room air can for the most part be avoided.

Furthermore, the intention is to prevent the filter that is to be provided from being clogged by deposits of the aforementioned contaminants. Furthermore, it is to be possible to detect the formation of contaminants in the cooling air circuit of the product display cabinet.

This object is achieved by a product display cabinet that is characterized in that in and/or on the product display cabinet there is at least one sensor that is used to detect contaminants and/or particles of dirt in the cooling air flow.

Therefore, according to the invention, there are corresponding sensors or detectors that are suited for detection of contaminants, dirt particles or dust.

If the product display cabinet has at least one cooling air inlet area or at least one cooling air outlet area and/or at least one evaporator, the sensor or sensors in the or a cooling air inlet area and/or in the or a cooling air outlet area and/or in the flow direction are located essentially directly upstream and/or downstream from the evaporator or evaporators.

Based on the concentration of the cooling air flow in the aforementioned areas, detection of the concentration of contaminants or dirt particles at these locations can be done especially efficiently and, moreover, comparatively easily.

As a development of the product display cabinet according to the invention, it is suggested that the sensor or sensors be dynamically connected to a warning device (as shown in FIG. 1) that is activated when a set contaminant and/or dirt particle value is exceeded. Here, the warning device preferably generates an optical and/or acoustic warning signal.

Especially in smaller stores or markets, personnel can be immediately notified that a malfunction is occurring or has occurred, so that corresponding (counter) measures can be initiated.

In supermarkets or the like in which the individual product display cabinets are monitored in a control center and by means of a central computer, the warning device is preferably connected to the control center or the central computer. A corresponding warning signal is then generated by the control center or the central computer.

According to another advantageous embodiment of the product display cabinet according to the invention, there is at least one contaminant filter within the flow path of the cooling air.

These contaminant filters can preferably be arranged such that prompt and simple replacement is possible.

Preferably at least one contaminant filter is located in the cooling air inlet area and/or the cooling air outlet area of the product display cabinet according to the invention.

In addition, the contaminant filter or filters is/are connected preferably to a control center, a central computer or the like so that when the maximum holding capacity of the contaminant filter is reached, a warning signal can be generated by the control center or the central computer.

Figure 2:
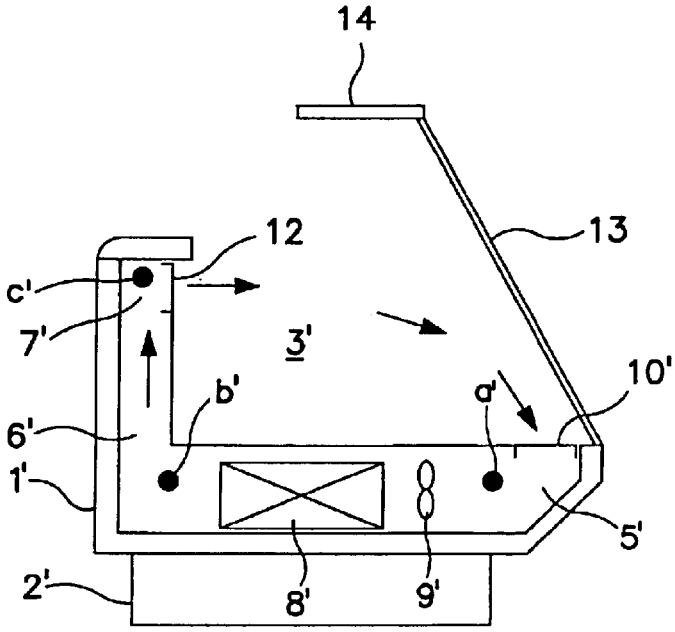
Figure 3:
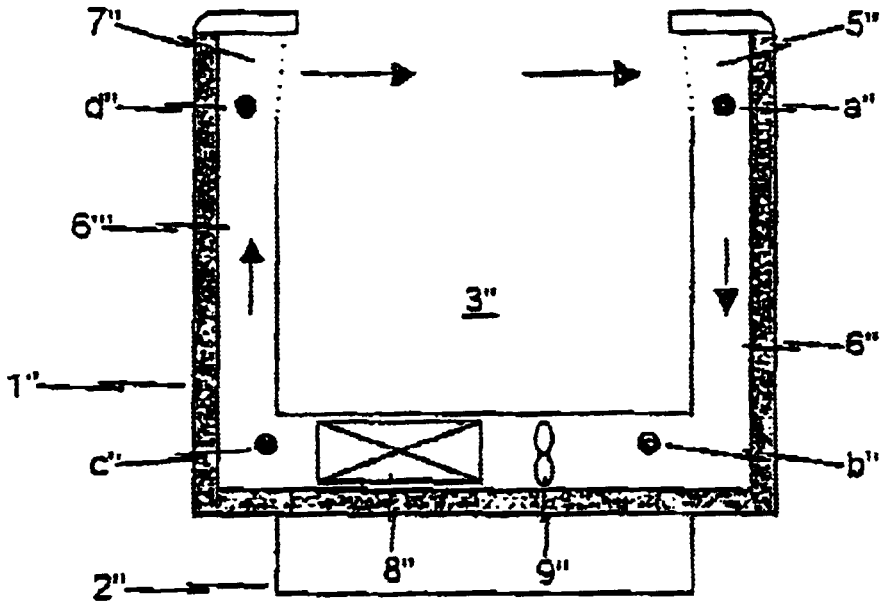

The product display cabinet according to the invention and other configurations thereof are explained in more detail using three embodiments shown in FIGS. 1 to 3.

Here:

FIG. 1 shows a side cross section of a (depicted diagrammatically) refrigerator FIG. 2 shows a side cross section of a (depicted diagrammatically) cold shelf FIG. 3 shows a side cross section of a (depicted diagrammatically) freezer chest.

The refrigerator shown in FIG. 1 has an insulated body 1 that rests on a base 2. The insulated body 1 surrounds a product space 3 in which generally there are several product display bottoms 4. In the front, lower area of the cabinet, there is a return air grating 10 via which the cooling air—shown by the arrows—and air from the vicinity of the product display cabinet travels into the cooling air inlet area 5.

These air flows are taken in by means of a fan 9 and delivered to an evaporator 8 in which they are cooled. The cooled cooling air flow is then delivered again into the product space 3 via the rear return channel 6 and the return air channel 7 located in the upper area of the product display cabinet via the air inlet 11. In addition, generally the back wall of the product space 3 is made perforated so that cooling air from the return air channel 6 can enter the product space 3, this portion of cooling air flowing over the products located on the product display bottoms 4.

At this point, according to the invention there is at least one sensor that is used to detect contaminants or dirt particles in the cooling air flow. FIG. 1 shows four possible positions a to d for the arrangement of the sensor or sensors. Of course, other positions for the sensor arrangement are possible. FIG. 1 also shows a warning device connected to a sensor.

The cold shelves shown in a side cross section in FIG. 2 likewise have an insulated cabinet body 1' that rests on a base 2'. The product space 3' is closed towards the customer by a pane 13 of glass on which, as shown in FIG. 2, there can be a number and product transfer plate 14. In the rear upper area of the insulated cabinet body 1 on the end of the return air channel 6' there is a feed air grating 12 via which the cooling air that has been cooled in the evaporator 8' enters the product space 3' of the cabinet. The cooling air is then taken in again via the return air grating 10' by means of the fan 9' into the inlet area 5'.

FIG. 2 shows three possible positions a' to c' for the arrangement of suitable sensors.

FIG. 3 shows in a side cross section a chest freezer with an insulated cabinet body 1" that rests on a base 2". Underneath the product space 3" there are an evaporator 8" and a fan 9". By means of the fan 9", a flow of air is taken in via the return air channel 6" and supplied to the evaporator 8". The cooled cooling air flow is then delivered again into the product space 3" via the inlet air channel 6". While a partial flow of the cooling air flow "falls" into the product space 3", the remaining partial flow of the cooling air flow is supplied again to the evaporator 8", as already described.

Possible positions a" to d" for the arrangement of suitable sensors are the cooling air inlet area 5", the cooling air outlet area 7" and/or the areas in the flow direction upstream or downstream from the evaporator 8".

The evaporators 8 to 8" and fans 9 to 9" shown in FIGS. 1 to 3 can, of course, also be located at another suitable location within the product display cabinet. Accordingly, the possible positions for the sensors can change.

FIGS. 1 to 3 show the product display cabinet in which cooling of the product space or spaces takes place by means of circulation cooling. It goes without saying for one skilled in the art, however, that the invention can also be used in product display cabinets with product spaces cooled solely by means of so-called static cooling or with a combination of circulation cooling and static cooling.

What is claimed is:

1. An at least partially cooled product display cabinet comprising:

a product display cabinet, means for cooling said cabinet, said means for cooling comprising at least one means for flowing cooled air into at least one area of said product display cabinet, at least one means for static cooling, or both, at least one sensor (a, a', a", b, b', b", c, c', c", d, d', d"), in and/or on the product display cabinet, for detecting and measuring contaminants and/or particles of dirt in the flowing cooled air, and a warning device wherein said at least one sensor (a, a', a", b, b', b", c, c', c", d, d', d") is dynamically connected to said warning device, said warning device is activatable in response to a set contaminant and/or dirt particle value being exceeded.

2. An at least partially cooled product display cabinet according to claim 1, wherein said means for cooling said cabinet comprises at least one cooling air inlet area (5, 5', 5"), at least one cooling air outlet area (7, 7', 7"), and at least one evaporator (8, 8', 8"), wherein said at least one sensor (a, a', a", b, b', b", c, c', c", d, d', d") is in the cooling air inlet area (5, 5', 5"), in the cooling air outlet area (7, 7', 7"), in the region between said at least one cooling air inlet area and said at least one cooling air outlet area, and is located essentially directly upstream or downstream from said at least one evaporator (8, 8', 8").

3. An at least partially cooled product display cabinet according to claim 1, wherein the warning device is capable of generating an optical and/or acoustic warning signal.

4. An at least partially cooled product display cabinet according to claim 1, wherein the warning device is connected to a control center or a central computer.

5. An at least partially cooled product display cabinet according to claim 4, wherein the control center or central computer generates an optical and/or acoustic warning signal.

6. An at least partially cooled product display cabinet according to claim 2 further comprising at least one filter for removing contamination from said cooled air.

7. An at least partially cooled product display cabinet according to claim 6, wherein said at least one contaminant filter is located in the cooling air inlet area (5, 5', 5") and/or the cooling air outlet area (7, 7', 7").

8. An at least partially cooled product display cabinet according to claim 6, wherein said at least one contaminant filter is connected to a control center or a central computer.

9. An at least partially cooled product display cabinet according to claim 3, wherein the warning device is connected to a control center or a central computer.

10. An at least partially cooled product display cabinet according to claim 9, wherein the control center or central computer generates an optical warning signal.

11. An at least partially cooled product display cabinet according to claim 1, wherein said means for cooling said cabinet comprises at least one cooling air inlet area, at least one cooling air outlet area, and at least one evaporator positioned downstream from said at least one cooling air inlet area and upstream from said at least one cooling air outlet area, wherein said at least one sensor is located in the cooling air inlet area.

12. An at least partially cooled product display cabinet according to claim 1, wherein said means for cooling said cabinet comprises at least one cooling air inlet area, at least one cooling air outlet area, and at least one evaporator positioned downstream from said at least one cooling air inlet area and upstream from said at least one cooling air outlet area, wherein said at least one sensor is located in the cooling air outlet area.

13. An at least partially cooled product display cabinet according to claim 1, wherein said means for cooling said cabinet comprises at least one cooling air inlet area, at least one cooling air outlet area, and at least one evaporator positioned downstream from said at least one cooling air inlet area and upstream from said at least one cooling air outlet area, wherein said at least one sensor is located positioned downstream from said at least one cooling air inlet area and upstream from said at least one evaporator.

14. An at least partially cooled product display cabinet according to claim 1, wherein said means for cooling said cabinet comprises at least one cooling air inlet area, at least one cooling air outlet area, and at least one evaporator positioned downstream from said at least one cooling air inlet area and upstream from said at least one cooling air outlet area, wherein said at least one sensor is located positioned upstream from said at least one cooling air outlet area and downstream from said at least one evaporator.

15. An at least partially cooled product display cabinet according to claim 3, wherein the warning device is capable of generating an optical warning signal.

16. An at least partially cooled product display cabinet according to claim 3, wherein the warning device is capable of generating an acoustic warning signal.

17. An at least partially cooled product display cabinet according to claim 5, wherein the control center or central computer generates an optical warning signal.

18. An at least partially cooled product display cabinet according to claim 5, wherein the control center or central computer generates an acoustic warning signal.

19. An at least partially cooled product display cabinet according to claim 6, wherein said at least one contaminant filter is located in the cooling air inlet area.

20. An at least partially cooled product display cabinet according to claim 6, wherein said at least one contaminant filter is located in the cooling air outlet area.

21. An at least partially cooled product display cabinet according to claim 9, wherein the control center or central computer generates an acoustic warning signal.

22. A process for at least partially cooling a product display cabinet and monitoring contamination thereof, said product display cabinet having means for cooling said cabinet, said means for cooling comprising at least one means for flowing cooled air into at least one area of said product display cabinet, at least one means for static cooling, or both, said process comprising:

providing at least one sensor, in and/or on the product display cabinet, for detecting and measuring contaminants and/or particles of dirt in the flowing cooled air, and providing a warning device wherein said at least one sensor is dynamically connected to said warning device, said warning device is activatable in response to a set contaminant and/or dirt particle value being exceeded.

23. A process according to claim 22, wherein the warning device is capable of generating an optical warning signal.

24. A process according to claim 22, wherein the warning device is capable of generating an acoustic warning signal.

* * * * *